US007878563B2

(12) United States Patent
Beckham et al.

(10) Patent No.: US 7,878,563 B2
(45) Date of Patent: Feb. 1, 2011

(54) COMBINATION CHOPSTICK UTENSIL

(75) Inventors: D. Scott Beckham, Costa Mesa, CA (US); Jordan Michael Brown, Holladay, UT (US)

(73) Assignee: Brown Innovation Group, Inc., Holladay, UT (US)

( * ) Notice: Subject to any disclaimer, the term of this patent is extended or adjusted under 35 U.S.C. 154(b) by 89 days.

(21) Appl. No.: 12/116,037

(22) Filed: May 6, 2008

(65) Prior Publication Data

US 2009/0278364 A1 Nov. 12, 2009

(51) Int. Cl.
*A47G 21/10* (2006.01)

(52) U.S. Cl. ..... 294/1.1

(58) Field of Classification Search ..... 294/1.1, 294/51, 99.2; D7/642, 643; 30/142, 123
See application file for complete search history.

(56) References Cited

U.S. PATENT DOCUMENTS

| | | | |
|---|---|---|---|
| 2,711,339 | A | 6/1955 | McGogy |
| 2,757,951 | A | 8/1956 | Benton |
| 2,997,328 | A | 8/1961 | Lee |
| 3,637,248 | A | 1/1972 | Arita |
| 3,807,781 | A | 4/1974 | Rollband |
| D279,852 | S | 7/1985 | Yokoyama |
| 4,576,408 | A | 3/1986 | Maneki |
| 4,659,128 | A | 4/1987 | Dong |
| 4,809,435 | A | 3/1989 | Printz |
| 4,826,227 | A | 5/1989 | Lew |
| D309,695 | S | 8/1990 | Bonasia |
| 4,973,095 | A | 11/1990 | Kunihisa |
| 5,056,173 | A | 10/1991 | Brincat |
| 5,373,640 | A | 12/1994 | Cordeiro, Jr. |
| D386,050 | S | 11/1997 | Puri |
| 5,697,659 | A | 12/1997 | Calagui |
| 5,810,411 | A | 9/1998 | Major |
| 5,911,462 | A | 6/1999 | Hui |
| D433,883 | S | 11/2000 | Wei |
| 6,276,734 | B1 | 8/2001 | Krieger |
| 6,454,328 | B1 | 9/2002 | Barillos |
| 6,457,238 | B1 | 10/2002 | Maier et al. |

(Continued)

FOREIGN PATENT DOCUMENTS

| | | | |
|---|---|---|---|
| DE | 4335907 | * | 4/1995 |

(Continued)

*Primary Examiner*—Paul T Chin
(74) *Attorney, Agent, or Firm*—Webb IP Law Group; Jason P. Webb; Danny Y.H. Cheng

(57) ABSTRACT

A combination chopstick utensil may comprise a first chopstick member and a second chopstick member. A base may be coupled to each of the first and second chopstick members; wherein the base may include a first transition member. The base may also include a second transition member, wherein the second transition member may be coupled to the first transition member along an interior edge. The first and second transition members may be selectably coupleable. The base may further include a separation facilitation structure between the first and second transition members and configured to facilitate separation of the first and second transition members. The separation facilitation structure may include a groove between the first and second transition members. The combination chopstick utensil may also include a utensil coupled to the base and extending therefrom substantially opposite of the first and second chopstick members.

18 Claims, 9 Drawing Sheets

U.S. PATENT DOCUMENTS

| | | | | | |
|---|---|---|---|---|---|
| 6,581,997 | B1 | | 6/2003 | Martikainen et al. | |
| D539,615 | S | | 4/2007 | Weaver | |
| D601,389 | S | * | 10/2009 | Brown | D7/643 |
| 2009/0165307 | A1 | * | 7/2009 | Lam et al. | 30/123 |

FOREIGN PATENT DOCUMENTS

| | | | | |
|---|---|---|---|---|
| JP | 61-025877 | | 2/1986 | |
| JP | 03-044473 | | 4/1991 | |
| JP | 03-060573 | | 6/1991 | |
| JP | 06022837 | * | 2/1994 | 294/86.42 |
| JP | 09252910 | * | 9/1997 | |
| JP | 2003-199663 | * | 7/2003 | |
| JP | 2005-176956 | * | 7/2005 | |

* cited by examiner

COMBINATION CHOPSTICK UTENSIL

CROSS-REFERENCE TO RELATED APPLICATIONS

BACKGROUND OF THE INVENTION

Field of the Invention

The present invention relates to utensils, specifically to a combination chopstick utensil.

Chopsticks originated in ancient China as early as the Shang dynasty (1600-1100 BC) and were widely used throughout East Asia. Tools resembling chopsticks were also unearthed in the archaeological site Megiddo in Israel. Chopsticks were also common household items of civilized Uyghurs on the Mongolian steppes during the 6th-8th centuries.

Chopsticks are a typically a pair of small even-length tapered sticks, which are generally believed to have originated in ancient China, and are the traditional eating utensils of China, Japan, Korea, Taiwan, and Vietnam. Chopsticks are commonly used with their associated cuisine. Chopsticks can also now be found in some areas of Tibet and Nepal that are close to Han Chinese populations, due to cross-cultural influences. Chopsticks are commonly used in Xinjiang by Uyghurs and other nationalities to eat laghman. In South East Asia chopsticks are usually used when eating noodles. Chopsticks are commonly made of wood, bamboo, metal, bone, ivory, and in modern times, plastic as well. The pair of sticks is maneuvered in one hand—between the thumb and fingers—and used to pick up pieces of food.

However, with the wide spread of Asian cuisine throughout the western hemisphere, many users have a difficult time manipulating the chopsticks to pick up pieces of food. Accordingly, efforts have been made to facilitate use by those who may not be familiar with the techniques of using chopsticks. Some improvements have been made in the field. Examples of references related to the present invention are described below, and the supported teachings of each reference are incorporated by reference herein:

U.S. Pat. No. 4,809,435, issued to Printz, discloses an eating utensil which, when used, resembles chopsticks, but which does not require the skilled manipulation of chopsticks. The utensil includes a pair of handles resembling chopsticks that converge toward their distal ends, where they are secured to a food-engaging member, such as fork tines, a spoon, or other Western-style utensil. The food-engaging member may be detachably secured to the handles, to allow replacement of the handles of the food-engaging member if any of such components should break, and to allow substitution of a variety of types of food-engaging members, such as forks or spoons, as desired.

U.S. Pat. No. 5,056,173, issued to Brincat, disclose a combination fork and chopsticks utensil which is provided and consists of a chopsticks portion integral with and extending from a fork portion. The fork portion can namely be utilized for picking up and eating food, while the chopsticks portion can at times also be used for eating food.

U.S. Pat. No. 5,697,659, issued to Calagui, discloses an eating utensil in the nature of an improved chop stick system which includes a first elongate member having a ratio of length to average cross-section in the range of about 20:1 to about 60:1. The utensil also includes a second elongate member of substantially like geometry to the first member. The eating utensil further includes a spring like element for providing an outward angular bias, the element including two opposing arms, one of each of the arms secured to opposing lateral surfaces of the first and second members, the lateral surfaces being near respective opposing ends of each of the elongate members. The eating utensil yet further includes a guide element for limiting the angular extent in plane of travel of one of the members relative to the other member.

U.S. Pat. No. 5,911,462, issued to Hui, discloses a chopstick holder comprising a housing having first and second opposed side walls and first and second opposed end walls, the housing having a substantially rectangular cross sectional configuration with an open up end and an open lower end, at least one wall retaining segment extending between the first and second side walls, the wall segments being designed to define a channel for a first chopstick and being designed to retain a leaf spring which biases a second chopstick against a second end wall. One of the end walls extends downwardly a distance substantially longer than the other side wall to provide support and thereby permit use of only the index finger for operation of the chopsticks.

U.S. Pat. No. 6,454,328, issued to Barillos, discloses a compact and convenient chopstick system which includes a first elongate member having a proximal end and a distal food engagement end, the member further having an outer lateral surface and an inner lateral surface comprising engagement means at the distal end. At the proximal end of the inner surface is a male journal surface including a transverse pivot channel and a transverse rotation-limit surface, and a U-shaped channel within a distal side of the journal surface of the inner lateral surface. The utensil further includes a second elongate member having a proximal end and a distal food engagement end, the member further having an outer surface and an inner surface comprising engagement means at the distal end and a female journal surface, complemental to the male journal surface of the first elongate member, including a transverse pivot channel co-linear with the channel of the male surface, and a transverse rotation limit surface complemental to the rotational limit surface of the first elongate member. The second member also includes a U-shaped channel within a distal side of the journal surface of the inner surface of the second elongate member.

U.S. Pat. No. 6,581,997, issued to Martikainen et al., discloses chopsticks formed by two separate chopsticks that during their use are detachably joined to each other, whereby the combination thereof is formed by two blanks called the joint portion blank and the picking portion blank. The invention is implemented through having the joint portion blank fabricated by providing at least one of sticks with a notch on which the other stick is superimposed thus allowing the sticks to function as pincer-like pair.

U.S. Pat. No. 7,017,964, issued to Hao, discloses a chopstick manipulating device which includes a resilient connecting member having a pair of inwardly angled side members and a bottom portion extending there between to form a triangular member with an open top. A pair of chopstick keepers has coplanar substantially triangular-shaped board portions disposed on the rear of board member and outwardly extending posts disposed on an outer corner of the substantially triangular-shaped board portions. Elastic boards extend outwardly from a top portion of the board members. A back surface of each of the board members of the chopstick keepers is coupled to an outer surface of a respective side member of the resilient connecting member. The respective board member, post and elastic board define an open channel for releasably and slideably securing a chopstick against the triangular-shaped board portion. The chopsticks pivot as the resilient connecting member is opened and closed.

U.S. Patent Application Publication No.: 2007/0033809, by Shirazi, discloses a combination eating utensil comprising a first eating utensil, a second eating utensil, a third eating utensil and a plurality of connection means for removably engaging the third eating utensil to the first and second eating utensils. The first eating utensil has a first chopstick section and a fork section. The second eating utensil has a second chopstick section and a spoon section, the spoon section mechanically couples to at least a portion of the first chopstick section and the fork section mechanically couples to at least a portion of the second chopstick section to form a receiving space there between. The third eating utensil is disposed in the receiving space and mechanically coupled to the first and the second eating utensils.

U.S. Patent Application Publication No.: 2005/0082855, by Baxter, discloses a chopsticks holding and positioning aid that effectively both assists the user in holding the chopsticks and also stabilizes these sticks into proper orientation, preventing them from crossing over and even creating an effective gentle spring return action but does not interfere with the natural holding techniques of the user. These chopsticks holders are created with simplicity of design. They are extremely low cost to produce can even be made out of environmentally friendly and recyclable materials are intended to be disposable. These chopsticks holders are fabricated from single pieces of flexible materials having with no joints, springs nor moving parts. Also, my chopstick aid will fit chopsticks of virtually any dimension and width including disposable wooden chopsticks and thick heavy fine restaurant standards. In addition, when used in stacked combination these chopsticks holders can provide progressive levels or resistance that can be matched with the users ability level or can be used as components in the teaching of chopsticks usage. Furthermore, these tools are esthetically pleasing and visually complementary to chopsticks and can easily be printed serving a secondary function as print sources for Diners to read or be entertained.

The inventions heretofore known suffer from a number of disadvantages which include being limited in application, being bulky, being difficult to use, being limited in versatility, being expensive, being limited in adaptability, and being flimsy.

What is needed is a combination chopstick utensil that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available utensils. Accordingly, the present invention has been developed to provide an efficient and effective combination chopstick utensil.

A combination chopstick utensil may comprise a first chopstick member and a second chopstick member. The first and second chopstick members may include a tubular member configured to couple to a base of the utensil. The first and second chopstick members may be configured to taper and funnel into the base of the utensil. The base may be coupled to each of the first and second chopstick members; wherein the base may include a first transition member. The base may also include a second transition member, wherein the second transition member may be coupled to the first transition member along an interior edge.

The base may further include a separation facilitation structure between the first and second transition members and configured to facilitate separation of the first and second transition members. The separation facilitation structure may include a groove between the first and second transition members. The combination chopstick utensil may also include a utensil coupled to the base and extending therefrom substantially opposite of the first and second chopstick members. Furthermore, the first transition member of the base may also include a hook end configured to couple to a receiving member of the second transition member; wherein the first and second transition members may be selectably coupleable.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not therefore to be considered to be limiting of its scope, the invention will be described and explained with additional specificity and detail through the use of the accompanying drawing(s), in which.

DETAILED DESCRIPTION OF THE INVENTION

Figure 1A:
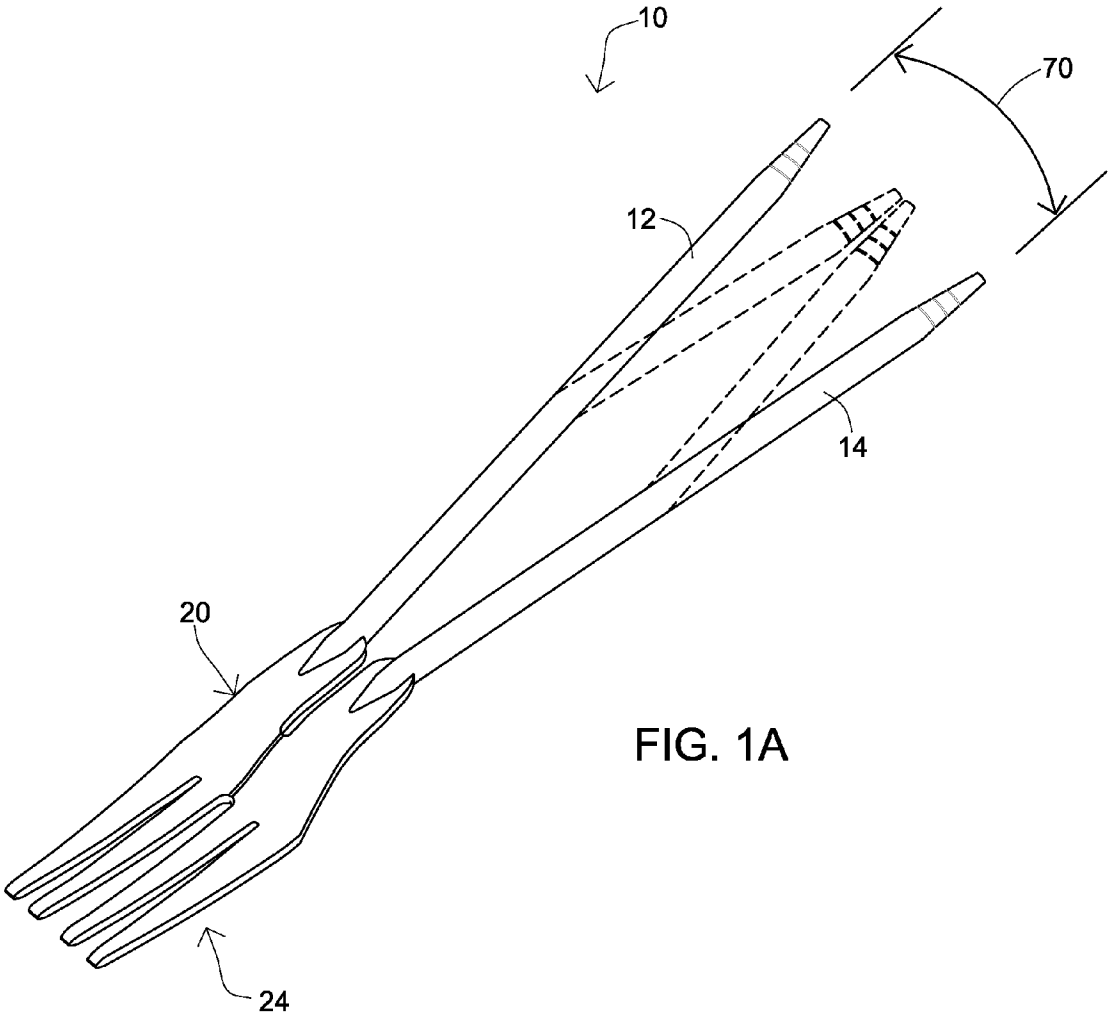
FIG. 1*a* is a top perspective view of a combination chopstick utensil, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment or example is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1A illustrates a combination chopstick utensil 10, according to one embodiment of the invention, wherein the combination chopstick utensil 10 includes a first chopstick member 12 and a second chopstick member 14. The first and second chopstick members 12, 14 are coupled to a base 20. The base includes a utensil 24 coupled to a side of the base 20, opposite of the first and second chopstick members 12, 14. As illustrated, the first and second chopstick members 12, 14 are substantially not parallel to one another. The first and second chopstick members 12, 14 may vary about an angle 70, wherein the configuration is substantially non-parallel.

Figure 1B:
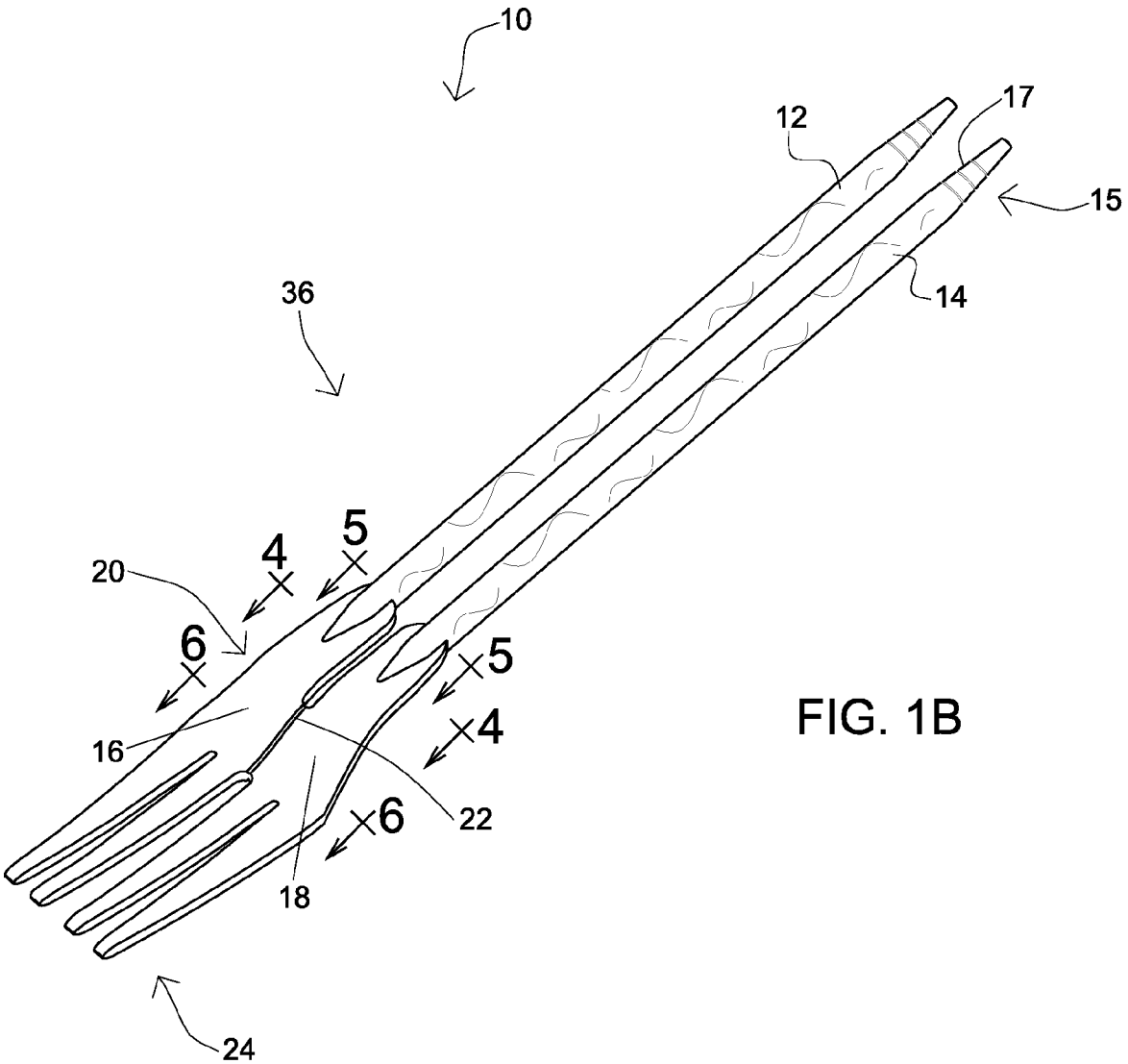
FIG. 1*b* is a top perspective view of a combination chopstick utensil, according to one embodiment of the invention.

FIG. 1B illustrates a combination chopstick utensil 10, according to one embodiment, wherein the combination chopstick utensil 10 includes a first chopstick member 12 and a second chopstick member 14. The first and second chopstick members 12, 14 are coupled to a base 20. The illustrated base 20 includes a first transition member 16 and a second transition member 18, wherein the first and second transition members 16, 18 are coupled together. The base 20 also includes a separation facilitation structure 22, wherein the structure 22 is configured to facilitate separation of the first and second transition members 16, 18. The separation facilitation structure includes a groove 40 configured to facilitate separation. The illustrated base 20 also includes a utensil 24 coupled to a side of the base, opposite of the first and second chopstick member 12, 14. As illustrated, the first and second chopstick members 12, 14 include a textured surface, wherein the textured surface enables a user to grip the chopstick members 12, 14 when in a combined chopstick utensil configuration 36.

The chopstick members 12 and 14 may be a tubular configuration. The illustrated first and second chopstick members 12, 14 taper and funnel into the base 20. The funnel-shaped or conic configuration enables the first and second chopstick members 12, 14 to support the base 20 when in a combined chopstick utensil configuration 36. The radius of the first and second chopstick members 12, 14 decrease in thickness towards the base 20 in a conic manner. This conic configuration increases the strength of the utensil 10 when in a combined chopstick utensil configuration 36. This configuration 36 is also easier to manufacture, wherein the manufacturing material is reduced. In addition, the chopstick member 12, 14 may also be hollow in configuration to further reduce manufacturing material. The length of the chopstick members 12, 14 are configured to enable the use of the individual chopstick members 12, 14 without being impeded by the utensil 24 of the base 20. Furthermore, the ends of the chopstick member 12, 14, opposite of the base 20, are configured with a textured surface 15. As illustrated, the chopstick members 12, 14 include an impression 17 configured to support food there between.

In operation of one embodiment of the invention, a user picks up the combination chopstick utensil 10 and manipulates the utensil 24 of the base 20. As illustrated the utensil 24 is configured to a fork end. The user manipulates the combination chopstick utensil 10 by supporting the first and second chopstick member 12, 14 like the handle of a fork and the user manipulates the food like a normal fork.

Figure 2:
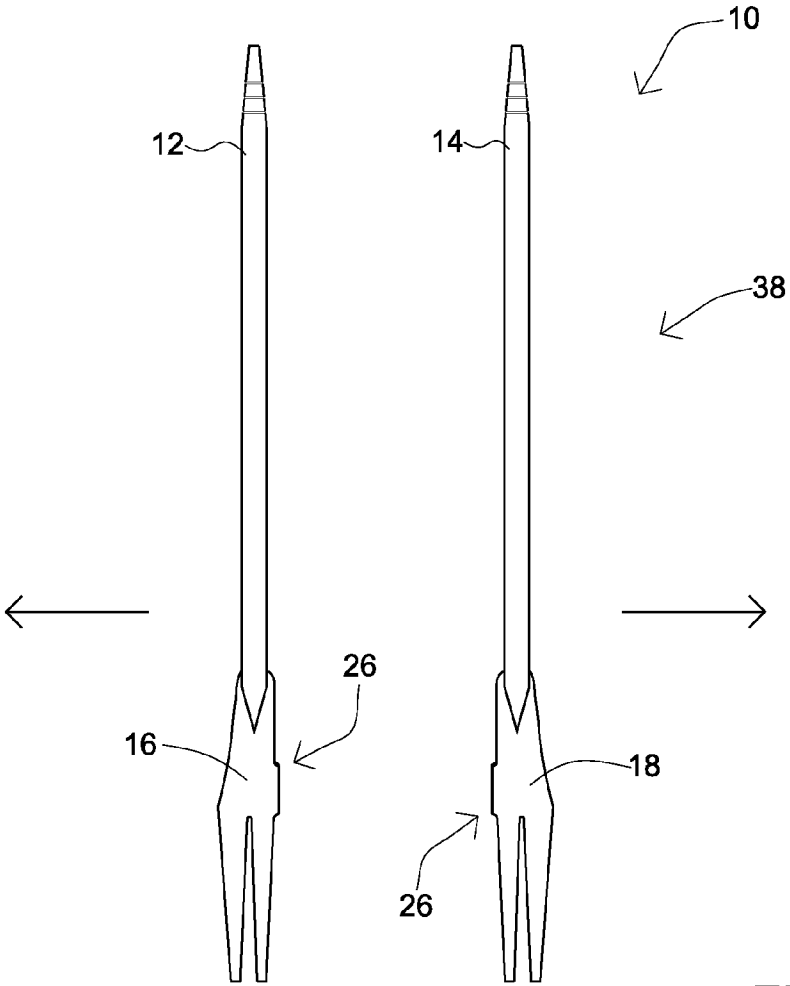
FIG. 2 is a top plan view of a combination chopstick utensil, according to one embodiment of the invention.

FIG. 2 illustrates a combination chopstick utensil 10, according to one embodiment, wherein the combination chopstick utensil 10 includes the first and second chopstick members 12, 14 separated by the separation facilitation structure 22 along an interior edge 26 of the base 20. The first and second transition members 16, 18 decouple along the interior edge 26 of the base 20. As illustrated, the combination chopstick utensil 10 is separated into a chopsticks configuration 38.

In operation of another embodiment of the invention, the user may apply pressure about the groove 40 of the separation facilitation structure 22 of the base 20 and break the first and second transition members 16, 18 apart from each other. The user may then reverse the ends of the combination chopstick utensil 10 and manipulate food with the first and second chopstick members 12, 14. The user holds the first and second chopstick members 12, 14 below the base 20 and manipulates food like normal chopsticks.

Figure 3:
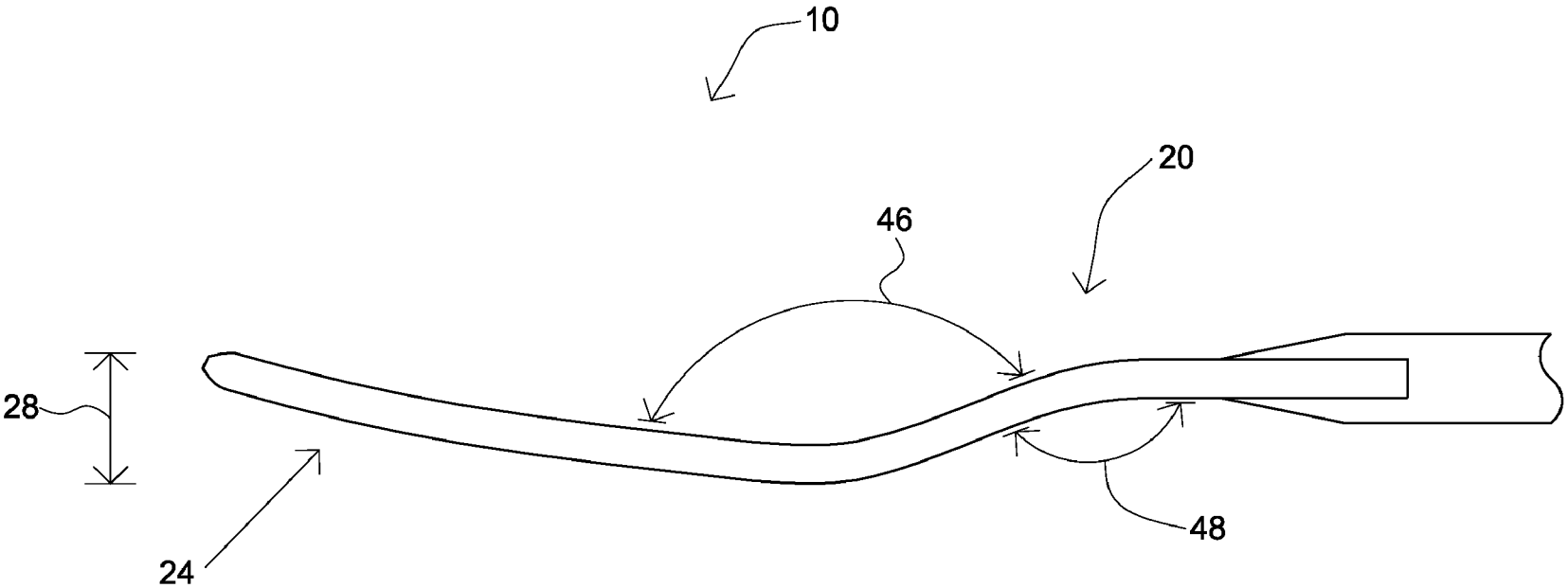
FIG. 3 is a partial side elevational view of a combination chopstick utensil, according to one embodiment of the invention.

FIG. 3 illustrates a combination chopstick utensil 10, according to one embodiment, wherein the combination chopstick utensil includes a utensil 24 coupled to a base 20 of the combination chopstick utensil 10. The base 20 includes a maximum profile 28 of a combination chopstick utensil 10, wherein the maximum profile 28 is less than a distance 30 between the first and second chopstick members 12, 14. The maximum profile 28 is the distance between the lowest portion of the utensil 24 and the uppermost portion of the utensil 24. When the chopstick members 12, 14 are separated and the utensil 24 is rotated the profile 28 is configured to uninhibit the use of the first and second chopstick members 12, 14 when in the chopsticks configuration 38.

In addition, a top angle 46 of the base 20 and a bottom angle 48 of the base are configured to create a fork profile, not exceeding the maximum profile. The top and bottom angles 46, 48 of the base 20 are also configured to support the pressure of the first and second chopstick members 12, 14, when manipulating food in a combined chopstick utensil configuration 36. In addition, the angles 46, 48 are configured to be substantially identical in order to uninhibit the use of the chopstick members 12, 14 when in a chopstick configuration 38.

Figure 4:
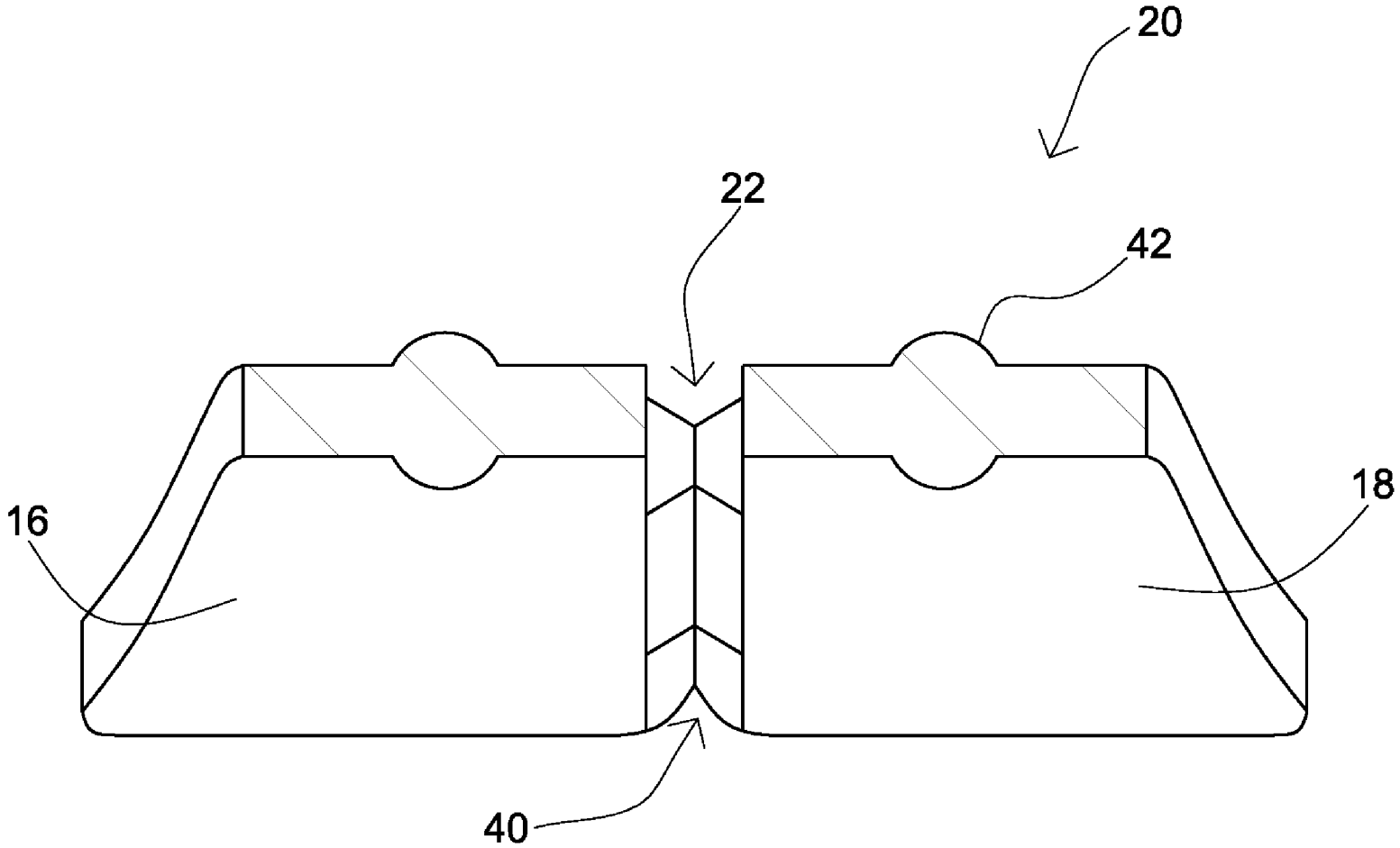
FIG. 4 is a cross sectional view of a separation facilitation structure of a combination chopstick utensil, according to one embodiment of the invention.
Figure 5:
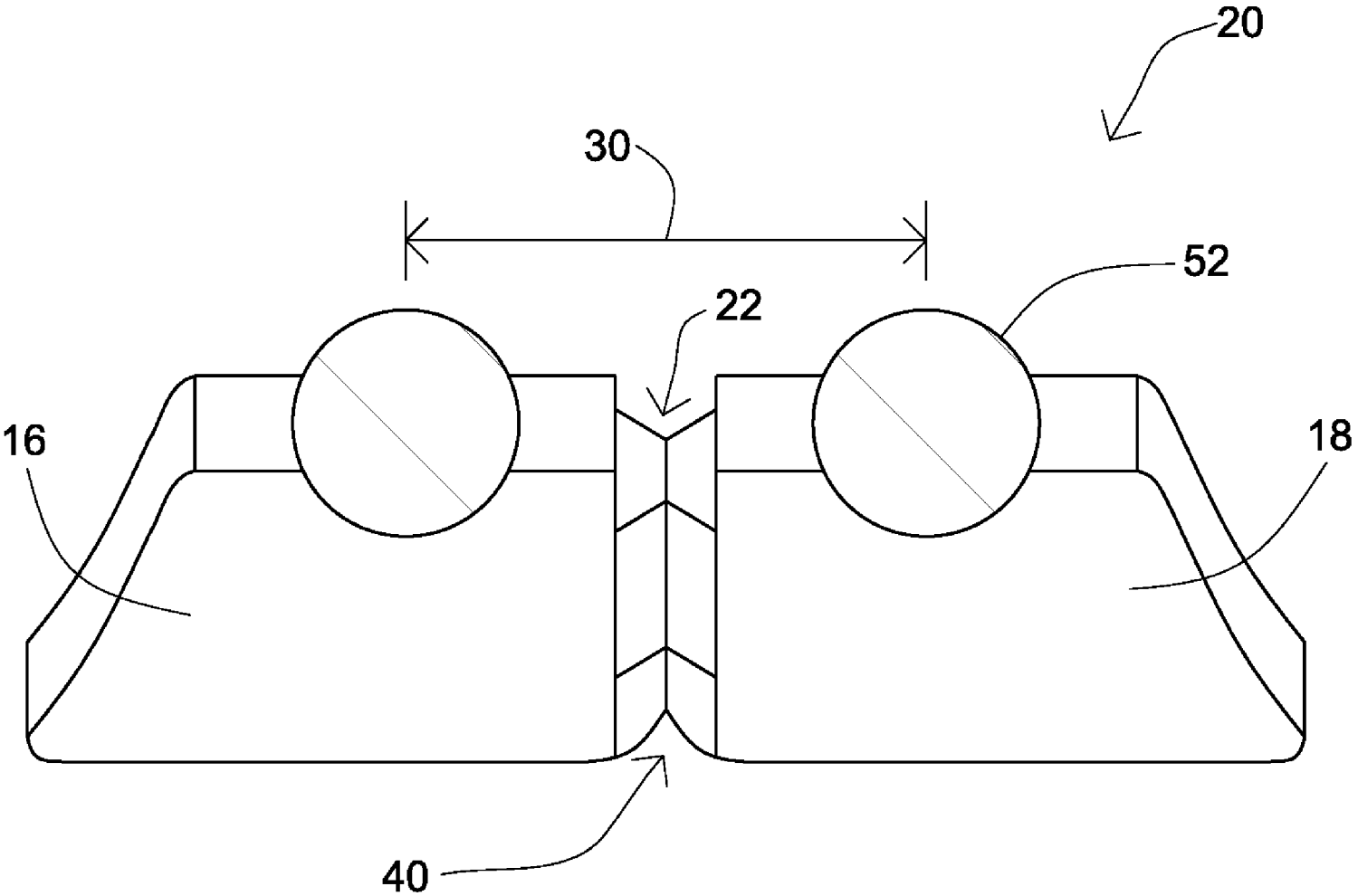
FIG. 5 is a cross sectional view of a separation facilitation structure of a combination chopstick utensil, according to one embodiment of the invention.
Figure 6:
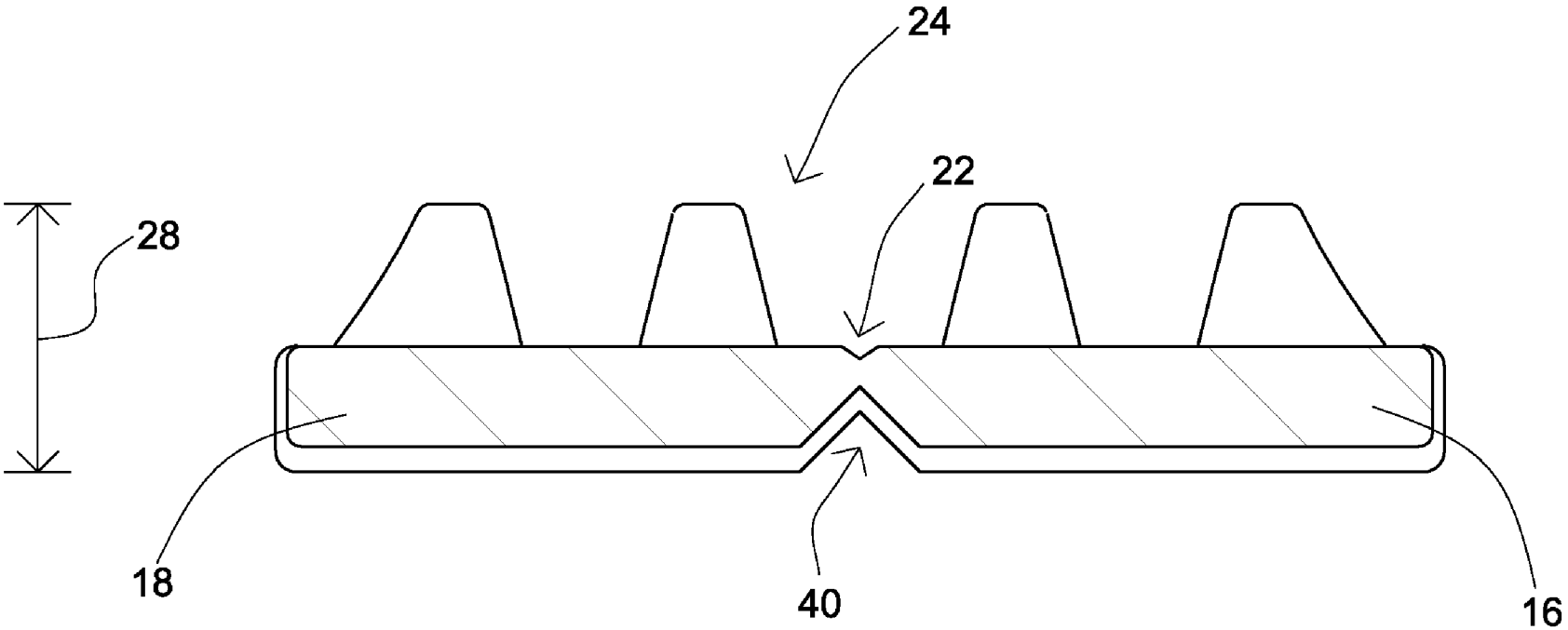
FIG. 6 is a cross sectional view of a separation facilitation structure of a combination chopstick utensil, according to one embodiment of the invention.

FIGS. 4-6 illustrate various illustrations of a separation facilitation structure 22 of a combination chopstick utensil 10, according to one embodiment, wherein a base 20 includes a facilitation structure 22 disposed between a first transition member 16 and a second transition member 18. As illustrated, the facilitation structure 22 includes a groove 40 configured to facilitate the separation of the first and second transition members 16, 18. In addition, a distance 30 between the first and second chopstick members 12, 14 is illustrated, wherein the distance 30 between the first and second chopstick members 12, 14 is configured to be greater than a maximum profile 28 of the base 20. This configuration enables the use of the chopstick members 12, 14 when in a chopsticks configuration 38 to be uninhibited by the utensil 24 of the base 20. As illustrated, FIG. 4 illustrates the chopstick members taper into the base, this configuration 42 enables for the base to be supported when in a combined chopstick utensil configuration. Furthermore, as illustrated in FIG. 5, the chopstick members may be in a substantially circular configuration 52, wherein the configuration enables support for the base when in a combined chopstick utensil configuration.

Figure 7:
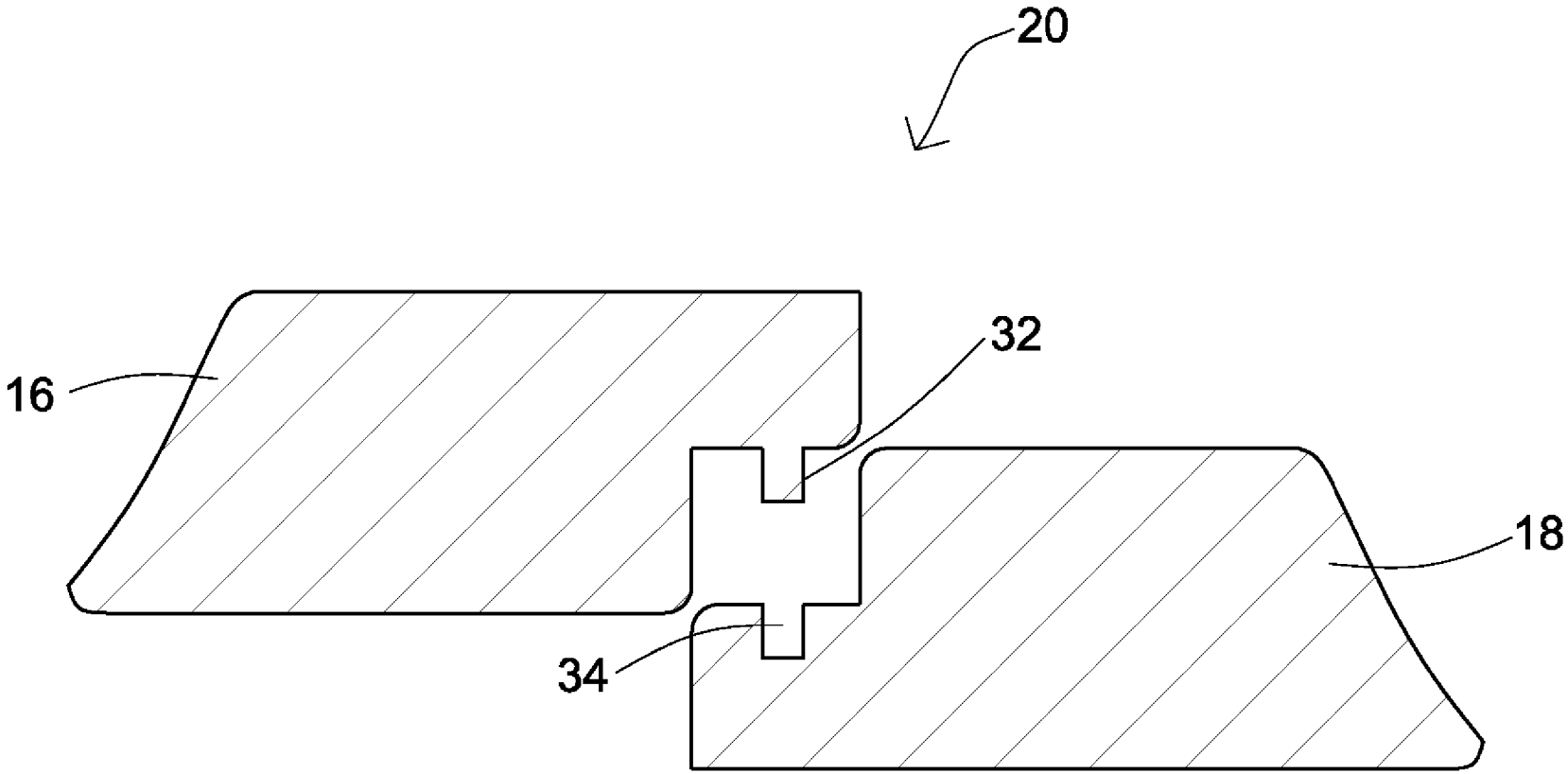
FIG. 7 is a cross-sectional view of a hook end and a receiving member of the first and second transition members of a combination chopstick utensil, according to one embodiment of the invention.

Furthermore, FIG. 7 illustrates a separation facilitation structure 22, according to one embodiment, wherein the structure 22 includes a hook end 32 coupled to the second transition member 18 and a receiving member 34 coupled to the first transition member 16. The hook end 32 of the second transition member 18 is configured to selectably couple to the receiving member 34 of the first transition member 16.

Figure 8:
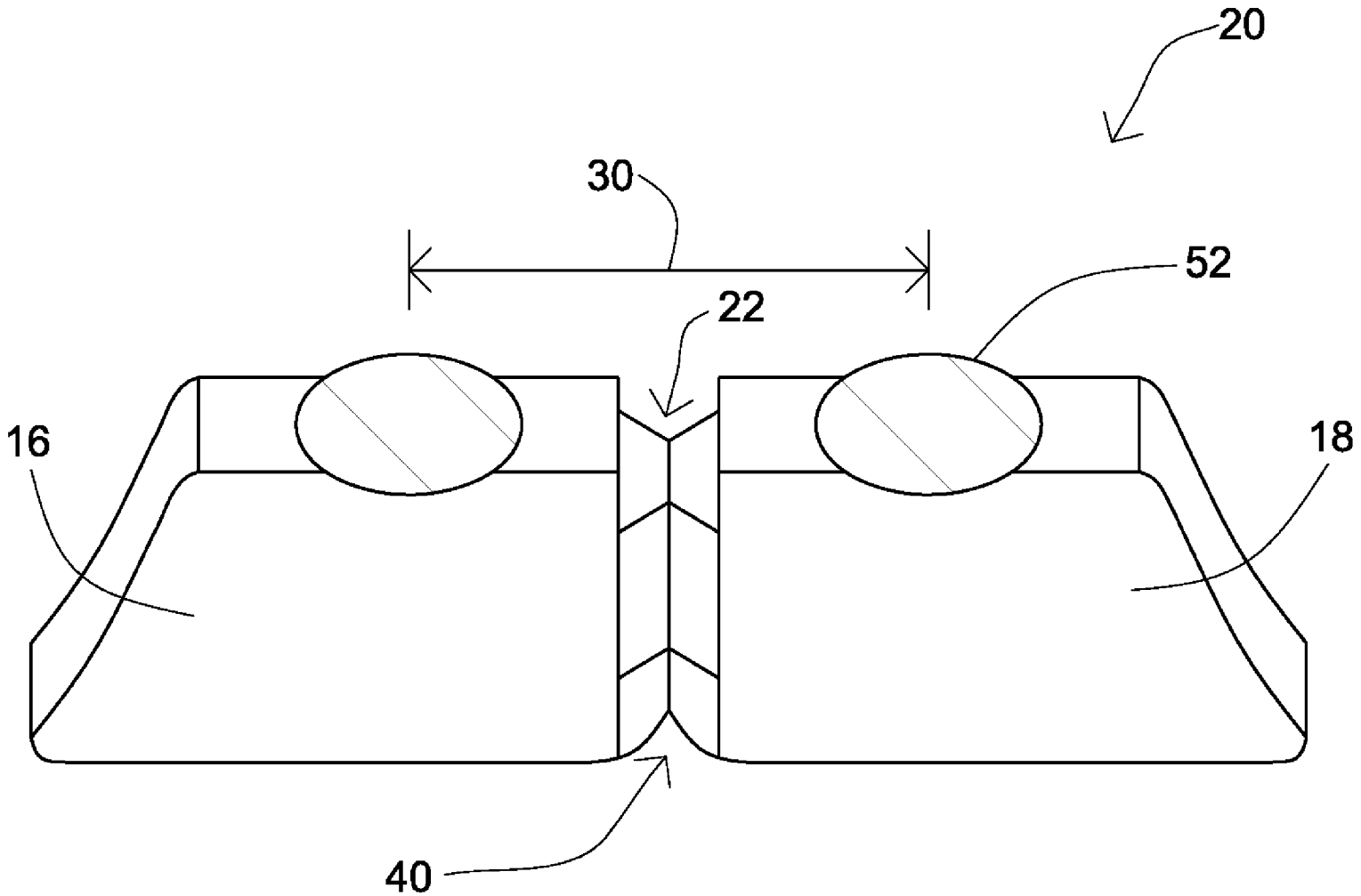
FIG. 8 is a cross sectional view of a separation facilitation structure of a combination chopstick utensil, according to one embodiment of the invention.

FIG. 8 illustrates a separation facilitation structure 22 of a combination chopstick utensil 10, according to one embodiment, wherein a base 20 includes a separation facilitation structure 22 disposed between a first and a second transition member 16, 18. As illustrated the first and second chopstick members are configured in an oval configuration 62, wherein the oval configuration 62 is configured to support the base when in a combined chopstick utensil configuration.

In operation of another embodiment of the combination chopstick utensil 10, the user may uncouple the hook end 32 of the second transition member 16 from the receiving member 34 of the first transition member 18 to the chopsticks configuration 38. The user may then couple the hook end 32 of the second transition member 18 to the receiving member 34 of the first transition member to the combination chopstick utensil configuration 36.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate a utensil being a fork, one skilled in the art would appreciate that the utensil may be but not limited to: a spoon, a knife, a fork, and any combination thereof, and still perform its intended function.

Additionally, although the figures illustrate a tubular chopstick member, one skilled in the art would appreciate that the chopstick members may be configured in a variety of shapes and sizes and still perform its intended function. Non-limiting examples may be a square shape, a pentagon shape, a hexagon shape, a octagon shape, and still perform its intended function It is also envisioned that the separation facilitation structure may vary in size, shape, configuration, design, and still perform its intended function.

It is expected that there could be numerous variations of the design of this invention. An example is that the ends of the chopstick members may vary in size, shape, configuration, design, and still perform its intended function. In addition, the ends of the chopstick members may include a textured surface, configured to help support the item of food between the chopstick members when in a chopsticks configuration.

Finally, it is envisioned that the components of the device may be constructed of a variety of materials, such as but not limited to: wood, plastic, plastic composites, glass, metals, metal alloys, metal composites, and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A combination chopstick utensil, comprising:

a) a first chopstick member and a second chopstick member;

b) a base coupled to each of the first and second chopstick members including:

b1) a first transition member;

b2) a second transition member coupled to the first transition member along an interior edge; and b3) a. separation facilitation structure between the first and second transition members and configured to facilitate separation of the first and second transition members; and c) a utensil coupled to the base and extending therefrom substantially opposite of the first and second chopstick members; wherein the first and second chopstick members are substantially non-parallel when in a combined chopstick utensil configuration.

2. The utensil of claim 1, wherein the separation facilitation structure includes a groove between the first and second transition members.

3. The utensil of claim 1, wherein the first and second transition members are selectably coupleable.

4. The utensil of claim 3, wherein the second transition member of the base includes a hook end configured to couple to a receiving member of the first transition member of the base.

5. The utensil of claim 1, wherein a maximum profile of a combination chopstick utensil is less than about a distance between the first and second chopstick members when in a combination chopstick utensil configuration.

6. The utensil of claim 1, wherein the first and second chopstick members taper into the base.

7. The utensil of claim 1, wherein the first and second chopstick members include a tubular member configured to couple the base.

8. The utensil of claim 1, wherein the first and second chopstick members are substantially oval in configuration.

9. The utensil of claim 1, wherein the first and second chopstick members include a textured surface.

10. A combination chopstick utensil, comprising:

a) a first chopstick member and a second chopstick member;

b) a base coupled to each of the first and second chopstick members including:

b1) a first transition member;

b2) a second transition member coupled to the first transition member along an interior edge; and b3) a separation facilitation structure between the first and second transition members and configured to facilitate separation of the first and second transition members; wherein the separation facilitation structure includes a groove between the first and second transition members; and c) a utensil coupled to the base and extending therefrom substantially opposite of the first and second chopstick members; wherein the first and second chopstick members are substantially non-parallel when in a combined chopstick utensil configuration.

11. A utensil of claim 10, wherein the first and second transition members are selectably coupleable.

12. A utensil of claim 10, wherein the second transition member of the base includes a hook end configured to couple to a receiving member of the first transition member of the base.

13. A utensil of claim 10, wherein a maximum profile of a combination chopstick utensil is less than about a distance between the first and second chopstick members when in a combination chopstick utensil configuration.

14. A utensil of claim 10, wherein the first and second chopstick members taper into the base.

15. A utensil of claim 10, wherein the first and second chopstick members include a tubular member configured to couple the base.

16. The utensil of claim 10, wherein the first and second chopstick members are substantially oval in configuration.

17. The utensil of claim 10, wherein the first and second chopstick members include a textured surface.

18. A combination chopstick utensil, comprising:

a) a first chopstick member and a second chopstick member; wherein a maximum profile of a combination chopstick utensil is less than about a distance between the first and second chopstick members when in a combination chopstick utensil configuration; wherein the first and second chopstick members taper into a base;

b) a base coupled to each of the first and second chopstick members including:

b1) a first transition member;

b2) a second transition member coupled to the first transition member along an interior edge; wherein the first and second transition members are selectably coupleable; wherein the second transition member of the base includes a hook end configured to couple to a receiving member of the first transition member of the base; and b3) a separation facilitation structure between the first and second transition members and configured to facilitate separation of the first and second transition members; wherein the separation facilitation structure includes a groove between the first and second transition members; and c) a utensil coupled to the base and extending therefrom substantially opposite of the first and second chopstick members; wherein the first and second chopstick members are substantially non-parallel when in a combined chopstick utensil configuration.

* * * * *